US011149339B2

(12) United States Patent
Iwasaki et al.

(10) Patent No.: US 11,149,339 B2
(45) Date of Patent: Oct. 19, 2021

(54) SLURRY FOR SUSPENSION PLASMA SPRAYING, AND METHOD FOR FORMING SPRAYED COATING

(71) Applicant: Shin-Etsu Chemical Co., Ltd., Tokyo (JP)

(72) Inventors: Ryo Iwasaki, Echizen (JP); Yasushi Takai, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 16/534,022

(22) Filed: Aug. 7, 2019

(65) Prior Publication Data

US 2020/0048752 A1 Feb. 13, 2020

(30) Foreign Application Priority Data

Aug. 10, 2018 (JP) ..... JP2018-151437

(51) Int. Cl.
*C23C 4/11* (2016.01)
*C23C 4/134* (2016.01)

(52) U.S. Cl.
CPC ..... *C23C 4/11* (2016.01); *C23C 4/134* (2016.01)

(58) Field of Classification Search
CPC ..... C23C 4/11; C23C 4/134; C04B 35/50; C04B 35/505
See application file for complete search history.

(56) References Cited

U.S. PATENT DOCUMENTS

| | | | | |
|---|---|---|---|---|
| 6,767,636 | B2 * | 7/2004 | Takai | C23C 4/11 423/263 |
| 10,377,905 | B2 * | 8/2019 | Kitamura | C23C 4/11 |
| 2003/0203120 | A1 * | 10/2003 | Tsukatani | C23C 4/11 427/446 |
| 2015/0361540 | A1 * | 12/2015 | Hamaya | C23C 4/134 501/126 |
| 2016/0024328 | A1 | 1/2016 | Kitamura et al. | |
| 2017/0088928 | A1 | 3/2017 | Ibe et al. | |
| 2017/0283933 | A1 | 10/2017 | Ibe et al. | |

FOREIGN PATENT DOCUMENTS

| | | | |
|---|---|---|---|
| JP | 2014-40634 A | | 3/2014 |
| JP | 2014062332 A | * | 4/2014 |
| JP | 2016138309 A | * | 8/2016 |
| JP | 5987097 B2 | * | 9/2016 |

* cited by examiner

*Primary Examiner* — Karl E Group

(74) *Attorney, Agent, or Firm* — Westerman, Hattori, Daniels & Adrian, LLP

(57) ABSTRACT

A slurry for use in suspension plasma spraying including a dispersion medium and rare earth oxide particles, the rare earth oxide particles having a particle size D50 of 1.5 to 5 μm and a BET specific surface area of less than 1 $m^2/g$, and a content of the rare earth oxide particles in the slurry being 10 to 45 wt %.

9 Claims, No Drawings

SLURRY FOR SUSPENSION PLASMA SPRAYING, AND METHOD FOR FORMING SPRAYED COATING

CROSS-REFERENCE TO RELATED APPLICATION

This non-provisional application claims priority under 35 U.S.C. § 119(a) on Patent Application No. 2018-151437 filed in Japan on Aug. 10, 2018, the entire contents of which are hereby incorporated by reference.

TECHNICAL FIELD

This invention relates to a slurry for use in suspension plasma spraying. The slurry may be used for forming a sprayed coating which is suitable for parts or members placed inside of a plasma etching apparatus used in a semiconductor manufacturing process. This invention relates also to a method for forming a sprayed coating.

BACKGROUND ART

A wafer as an object to be processed is treated under an atmosphere of halogen series gas plasma such as fluorine series gas plasma and chlorine series gas plasma in a plasma etching apparatus used in a semiconductor manufacturing process. As the fluorine series gas, $SF_6$, $CF_4$, $CHF_3$, HF or $NF_3$ is used, and as the chlorine series gas, $Cl_2$, $BCl_3$, HCl, $CCl_4$ or $SiCl_4$ is used.

For manufacturing parts or members exposed to a high corrosive gas plasma atmosphere in a plasma etching apparatus, generally, an erosion-resistant sprayed coating is formed on the surface of a substrate by atmospheric plasma spraying in which a raw material is supplied in powdery state. However, to spray the raw material in powdery state, it is preferable that spraying particles has an average particle size of at least 10 μm. If the particles have a smaller size than the range, a spraying material has disadvantageous fluidity for introducing the spraying material into a flame for thermal spraying, therefore, a supplying conduit may be clogged with the spaying material. Moreover, the particles are vaporized in the flame, thereby process yield may result in low. Furthermore, a dense sprayed coating cannot be obtained by spraying from particles having a large average particle size because a splat diameter of the particle is large, thereby crack and porosity increase, causing generation of particulates.

In particular, integration of a semiconductor is recently in progress to a wiring width of up to 10 nm. If particulates are peeled from the surface of a sprayed coating and fall onto a wafer in etching of a highly integrated semiconductor device, the phenomenon causes degradation of process yield for manufacturing the semiconductor device. Therefore, it is required that an erosion-resistant coating exposed to a plasma that is formed on parts or members of which a chamber of a plasma etching apparatus is composed has a higher erosion-resistance.

To solve the problem, suspension plasma spraying is investigated. In the suspension plasma spraying, spraying particles are sprayed not with a powdery state but a slurry form in which the spraying particles are dispersed in a dispersion medium. When spraying particles are sprayed with a slurry form, fine particles of up to 10 μm which is difficult to be applied to spraying with a powdery state can be introduced to a flame for thermal spraying, a splat diameter of the obtained sprayed coating is small in this case, thus, a very dense coating can be obtained.

CITATION LIST

Patent Document 1: JP-A 2014-40634

DISCLOSURE OF INVENTION

When thermal spraying is conducted with a slurry form, fine particles are supplied in a form of a slurry to obtain a dense coating. However, when the slurry is supplied from a slurry feed unit to a spray gun, a problem occurs in spraying such that particles adhere and retain at inner wall of a conduit, and the conduit is easy to be clogged, resulting difficulty to continue stable feeding of the slurry.

An object of the invention is to provide a slurry suitably used in suspension plasma spraying and can be supplied stably without clogging of a conduit, when a dense erosion-resistant coating used for parts or members placed inside of a plasma etching apparatus is formed by the suspension plasma spraying. Another object of the invention is to provide a method for forming a splayed coating by using the slurry.

The inventors have found that, as a slurry for thermal spraying including a dispersion medium and rare earth oxide particles, a slurry including rare earth oxide particles having a particle size D50 of 1.5 to 5 μm and a BET specific surface area of less than 1 $m^2/g$ can be continued stable feed of the slurry from a slurry feed unit to a spray gun because the particles has less contact points and are activated particle motion, thus, dispersibility increases. Further, the inventors have found that a dense sprayed coating having a high erosion-resistance can suitably be made by suspension plasma spraying by using the slurry.

In one aspect, the invention provides a slurry for use in suspension plasma spraying including a dispersion medium and rare earth oxide particles wherein the rare earth oxide particles have a particle size D50 of 1.5 to 5 μm and a BET specific surface area of less than 1 $m^2/g$, and a content of the rare earth oxide particles in the slurry is 10 to 45 wt %.

Preferably, the rare earth oxide particles have a particle size D10 of at least 0.9 μm, a particle size D90 of up to 6 μm, a crystalline size of at least 700 nm as measured on the is crystal plane (431) by X-ray diffraction method, or a total volume of pores having a diameter of up to 10 μm in the range of up to 0.5 $cm^3/g$ as measured by mercury porosimetry.

Preferably, the rare earth element of which the rare earth oxide particles is composed includes at least one element selected from the group consisting of Y, Gd, Tb, Dv, Ho, Er, Tm, Yb and Lu.

Preferably, the dispersion medium includes one or more selected from the group consisting of water and alcohols.

Preferably, the slurry includes a dispersing agent in the range of up to 3 wt %.

Preferably, the slurry has a viscosity of less than 15 mPa·s, or a sedimentation velocity of particles in the range of at least 50 μm/s.

In another aspect, the invention provides a method for forming a sprayed coating containing a rare earth oxide on a substrate by suspension plasma spraying with the slurry.

ADVANTAGEOUS EFFECTS OF INVENTION

When a slurry for thermal spraying of the invention is used, the slurry can be continued stable feed from a slurry feed unit to a spray gun without remnant of particles inside of the conduit and clogging of a conduit due to adhesion of particles at inner wall of the conduit. Further, a dense sprayed coating having a high erosion-resistance can be formed on a substrate from the slurry.

DESCRIPTION OF PREFERRED EMBODIMENTS

A slurry for thermal spraying of the invention includes a dispersion medium and rare earth oxide particles, and is suitable for use in suspension plasma spraying in which fine particles are sprayed in slurry form. The inventive slurry for thermal spraying can contribute stable formation of a sprayed coating including a rare earth oxide phase as a main phase. When the slurry is circulated in a conduit of a slurry feed unit for long time or the slurry is supplied from a slurry feed unit to a spray gun for long time, a conventional slurry for suspension plasma spraying including fine particles has problems such that a conduit is are easy to be clogged with the retained particles at the inner wall of the conduit, and stable feed of the slurry is hard to continue. On the other hand, the inventive slurry for thermal spraying can be continued stable feed without clogging of a conduit.

Rare earth oxide particles of the inventive slurry for thermal spraying preferably have a particle size D50 of up to 5 μm. In the present invention, the particle size D50 means a cumulative 50% diameter (median diameter) in volume basis particle size distribution. When the slurry is circulated in a conduit of a slurry feed unit or the slurry is supplied from a slurry feed unit to a spray gun, a slurry including small particles can be fed stably compared with a slurry including large particles. Further, when the particles included in the slurry has a small size, a size of a split that is formed by collision of a melted particle to a substrate in spraying in a slurry form is small, thereby a porosity of the resulting sprayed coating becomes low, and generation of cracks in the splats can be controlled. The particle size D50 is more preferably up to 4.5 μm, even more preferably up to 4 μm.

Rare earth oxide particles of the inventive slurry for thermal spraying preferably have a particle size D50 of at least 1.5 μm. When the rare earth oxide particles are sprayed in slurry form, the spraying particles having a large particle size included in the slurry have a large kinetic momentum, thereby the particles are easy to form splats by collision to a substrate. The particle size D50 is more preferably at least 1.8 μm, even more preferably at least 2 μm.

Rare earth oxide particles of the inventive slurry for thermal spraying preferably have a BET specific surface area of less than 1 $m^2/g$. Rare earth oxide particles having a small BET specific surface area has a reduced surface energy of the particle and a reduced contact points between particles in the slurry for thermal spraying, thereby, aggregation of particles can be controlled and dispersibility increases. The BET specific surface area is more preferably up to 0.9 $m^2/g$, even more preferably up to 0.8 $m^2/g$.

Generally, when a BET specific surface area of rare earth oxide particles becomes small, a particle size D50 becomes inversely large. Rare earth oxide particles of the inventive slurry for thermal spraying is small particles having a BET specific surface area of less than 1 $m^2/g$ and a particle size D50 of up to 5 μm, preferably 1.5 to 5 μm. These rare earth oxide particles have not been known for a slurry for suspension plasma spraying. These rare earth oxide particles are hard to aggregate in a slurry and contribute to improvement of flow-ability. Further, a sprayed coating formed with a slurry for thermal spraying including these rare earth oxide particles has a high hardness and is suitable for an erosion-resistant coating of a device for manufacturing a semiconductor.

Rare earth oxide particles of the inventive slurry for thermal spraying preferably have a particle size D10 of at least 0.9 μm. In the present invention, the particle size D10 means a cumulative 10% diameter in volume basis particle size distribution. When a particle size D10 of the rare earth oxide particles included in the slurry is large, during circulating the slurry in a conduit of a slurry feed unit or supplying the slurry from a slurry feed unit to a spray gun, clogging of the conduit with fine particles which are retained at inner wall of the conduit hardly occurs, and feed of the slurry is stably continued. Further, when a particle size D10 of the rare earth oxide particles included in the slurry is large, particle numbers introduced into the interior of a flame can be increased, thus, deposition rate to a substrate is increased. The particle size D10 is more preferably at least 1.0 μm, even more preferably at least 1.1 μm.

Rare earth oxide particles of the inventive slimy for thermal spraying preferably have a particle size D90 of up to 6 μm. In the present invention, the particle size D90 means a cumulative 90% diameter in volume basis particle size distribution. As treatment prior to set a slurry for thermal spraying to a slurry feed unit, particles are preferably passed through a sieve having an opening of, for example, about 20 μm to break aggregated particles or to prevent contamination of foreign material. In this case, when the particles included in a slurry for thermal spraying have a small D90 size, the particles are easy to pass the sieve. Further, when a particle size D90 of the rare earth oxide particles included in the slimy is small, even if an orifice that prevents to feed aggregated particles or foreign material to the spray gun is disposed in the conduit during circulating the slurry in a conduit of a slurry feed unit or supplying the slurry from the slurry feed unit to a spray gun, the particles are easy to pass through the orifice without clogging of the orifice. The particle size D90 is more preferably up to 5.8 μm, even more preferably up to 5.5 μm.

Rare earth oxide particles of the inventive slurry for thermal spraying preferably have a crystalline size of at least 700 nm as measured on the crystal plane (431) by X-ray diffraction method. The crystalline size is computed in accordance with Scherrer equation from a peak width at half height of a peak that belongs to the crystal plane (431) in the crystal lattice of the rare earth oxide. The peak of the crystal plane (431) is suitable for evaluating a crystalline size because, normally, no other peaks are detected near the peak of the crystal plane (431). Particles having a large crystalline size tend to be able to form a sprayed coating having a high hardness by suspension plasma spraying. The crystalline size is more preferably at least 800 nm, even more preferably at least 850 μm. As characteristic X-ray for X-ray diffraction, Cu Kα line is generally used.

Rare earth oxide particles of the inventive slurry for thermal spraying preferably have a total volume of pores having a diameter of up to 10 μm in the range of up to 0.5 $cm^3/g$. In the present invention, the total volume of pores having a diameter of up to 10 μm is measured by mercury porosimetry. A cumulative pore volume distribution relative to the pore diameter is normally measured in measurement of pore diameter distribution by mercury porosimetry, and the total volume of pores having a diameter of up to 10 μm is obtained from the result of the measurement. Particles having a small total volume of pores having a diameter of up to 10 μm can be controlled aggregation of secondary particles (formation of tertiary particles). The total volume of pores is more preferably up to 0.45 $cm^3/g$, even more preferably up to 0.4 $cm^3/g$.

The inventive slurry for thermal spraying preferably includes the rare earth oxide particles in the range of up to 45 wt %. When the content of the rare earth oxide particles in the slurry is small, particles motion increases, thus, dispersibility increases. Further, when the content of the rare earth oxide particles in the slurry is small, flowability of the slurry increases, thus, it is advantageous for feeding the slurry. The content of the rare earth oxide particles in the slurry is more preferably up to 40 wt %, even more preferably up to 35 wt %.

The inventive slurry for thermal spraying preferably includes the rare earth oxide particles in the range of at least 10 wt %. When the content of the rare earth oxide particles in the slurry is large, deposition rate of a sprayed coating obtained by thermal spraying of the slurry increases, and it can be lowered the consumption of the slurry or increased productivity of splaying. Further, when the content of the rare earth oxide particles in the slurry is large, spraying time can be shortened. The content of the rare earth oxide particles in slurry is more preferably at least 15 wt %, even more preferably at least 20 wt %.

If the amount is small enough not to impair the effect of the invention, the inventive slurry for thermal spraying may include any other particles other than rare earth oxide particles (for example, rare earth compound particles other than rare earth oxide particles). A content of the other particles is preferably up to 10 wt %, more preferably up to 5 wt %, even more preferably up to 3 wt % of the amount of the rare earth oxide particles in the slimy for thermal spraying. Most preferably, the slimy for thermal spraying substantively include none of the other particles other than the rare earth oxide particles. The other particles preferably have a particle size D50 in the same range of the particle size D50 of the rare earth oxide particles. As the rare earth compound particles other than rare earth oxide, a rare earth fluoride, a rare earth oxyfluoride, a rare earth hydroxide and a rare earth carbonate are exemplified.

In rare earth compound particles (typically, rare earth oxide particles) for use in tire inventive slurry for thermal spraying, or rare earth compound (typically, rare earth oxide) of which sprayed coating formed by using the slimy is composed, the rare earth element of winch rare earth compound (typically, rare earth oxide) is composed is preferably at least one element selected from the group consisting of Y, Sc, La, Ce, Pr, Nd, Sm, Eu, Gd, Tb, Dy, Ho, Er, Tm, Yb and Lu, more preferably, at least one element selected from the group coasisting of Y, Gd, Th, Dy, Ho, Er, Tm, Yb and Lu, however, is not limited thereto. The rare earth element may be used alone or in combination.

The dispersion medium of the inventive slurry includes one or more selected from the group consisting of water and organic solvents. The dispersion medium may be used as water alone, combination of water and one or more organic solvents, or one or more organic solvents only. As the organic solvent, alcohol, ether, ester and ketone are exemplified, however, not limited thereto. In particular, mono- or di-hydroxyl alcohols having 2 to 6 carbon atoms, ethers having 3 to 8 carbon atoms such as ethyl cellosolve, glycol ethers having 4 to 8 carbon atoms such as dimethyl diglycol (MIDG), glycol esters having 4 to 8 carbon atoms such as ethyl cellosolve acetate and but cellosolve acetate, and cyclic ketones having 6 to 9 carbon atoms such as isophorone are preferably exemplified. It is preferable that the organic solvent is water-soluble. The dispersion medium more preferably includes one or more selected from the group consisting of water and alcohols. Most preferably, the dispersion medium consists of water and/or one or more alcohols.

The inventive slurry for thermal spraying may include a dispersing agent in the range of up to 3 wt % to prevent aggregation of particles efficiently. The dispersing agent is preferably an organic compound, typically, a water-soluble organic compound, however, not limited thereto. As the water-soluble organic compound, surfactants are exemplified. Since the rare earth oxide particles are charged with positive zeta potential, an anion surfactant is preferable as the surfactant. In particular, polyalkylene imine series anion surfactant, polycarboxylic acid series anion surfactant, or polyvinyl alcohol series anion surfactant is more preferably used. When the dispersion medium includes water, an anion surfactant is preferable. On the other hand, when the dispersion medium consists of one or more organic solvents only, nonionic surfactant may be used. The content of the dispersing agent in slurry is more preferably up to 2 wt %, even more preferably up to 1 wt %.

The inventive slurry for thermal spraying preferably has a viscosity of less than 15 mPa·s. When the slurry has a low viscosity, particle motion is activated, thus, flowability of the slurry increases. The viscosity of the slurry is more preferably up to 10 mPa·s, even more preferably up to 8 mPa·s. The lower limit of the viscosity is preferably at least 1 mPa·s, more preferably at least 1.5 mPa·s, even more preferably at least 2 mPa·s, however, not limited thereto.

The inventive slurry for thermal spraying preferably has a sedimentation velocity of particles (typically, rare earth oxide particles) in the range of at least 50 μm/s. A high sedimentation velocity means that particles are easily movable in the slurry without resistance from their around. When the slurry has a high sedimentation velocity, flowability of the particles included in the slurry increases. The sedimentation velocity of the slurry is more preferably at least 55 μm/s, even more preferably at least 60 μm/s.

The inventive slurry for thermal spraying is suitable for a slurry for use in suspension plasma splaying. A sprayed coating suitably applicable to parts or members of a semiconductor manufacturing device can be formed on a substrate by using the inventive slimy. Further, a member on which the sprayed coating is formed can be manufactured by the method.

The suspension plasma spraying is preferably suspension plasma spraying in an atmosphere containing an oxygen-containing gas, especially atmospheric suspension plasma spraying where plasma is formed in an air atmosphere. The atmospheric suspension plasma spraying herein means suspension plasma spraying when ambient atmospheric gas for plasma formation is air. Plasma may be formed under normal pressure such as atmospheric pressure, under applied pressure or under reduced pressure.

As a material of a substrate, metals such as stainless steel, aluminum, nickel, chromium, zinc and alloys thereof, inorganic compounds (ceramics) such as alumina, zirconia, aluminum nitride, silicon nitride, silicon carbide and quartz glass, and carbon are exemplified. A suitable material may be selected depending on a particular application of a sprayed member (ex. for use in a semiconductor manufacturing device). For example, when aluminum metal or aluminum alloy is used as a substrate, an alumite-treated substrate having acid resistance is more preferable. As a shape of the substrate, for example, a flat plate shape and a cylindrical shape are exemplified, however, not limited thereto.

The plasma gas for plasma formation is preferably a gas mixture of at least two gases selected from argon gas, hydrogen gas, helium gas and nitrogen gas, a gas mixture of three gases consisting of argon gas, hydrogen gas and nitrogen gas, or a gas mixture of four gases consisting of argon gas, hydrogen gas, helium gas and nitrogen gas.

The spraying operation includes the steps of charging a slurry feeder with a slurry-including rare earth oxide particles and feeding the slurry with a carrier gas (typically argon gas) through a conduit (e.g., powder hose) to the tip of a nozzle of a plasma spray gun. The conduit preferably has an inner diameter of 2 to 6 mm. A sieve having opening size of up to 25 μm, preferably up to 20 μm may be installed in the conduit at an any position, for example, at its slurry feed inlet to prevent the conduit and the plasma spray gun from clogging.

As a powder, i.e., rare earth oxide particles are continuously fed by spraying the slurry in the form of droplets from a plasma spray gun into the plasma flame, the rare earth oxide is melted and liquefied, forming a liquid flame with the power of plasma jet. When the inventive slurry is used in suspension plasma spraying, the dispersion medium is evaporated in the plasma flame, thus, even small particles, which cannot be melted in the conventional plasma spraying adapted to feed a spray material in solid form, can be melted. Since the slurry contains no coarse particles, droplets of uniform size are formed. The inventive slurry for thermal spraying, especially, the slurry including rare earth oxide particles having a particle size D50 of 1.5 to 5 μm, a particle size D10 of at least 0.9 μm, and a particle size D90 of up to 6 μm, can form a denser erosion-resistant coating because the rare earth oxide particles has a sharp or narrow particle distribution, thus, the diameters of splats obtained by collision of droplets to a substrate become uniform. A sprayed coating including rare earth oxide can be formed by moving the liquid flame across a substrate surface horizontally or vertically by means of an automatic machine (i.e., robot) or human arm to move a predetermined region on the substrate surface.

The sprayed coating preferably has a thickness of at least 10 μm, more preferably at least 30 μm, even more preferably at least 50 μm, and preferably up to 500 μm, more preferably up to 400 μm, even more preferably up to 300 μm, however not limited thereto.

A spraying distance in suspension plasma slimy is preferably set to up to 100 mm, when the spraying distance is short, deposition rate of a sprayed coating increases, and hardness of the sprayed coating is increased and porosity of the sprayed coating is lowered. The spraying distance is more preferably up to 90 mm, even more preferably up to 80 mm. The lower limit of the spraying distance is preferably at least 50 mm, more preferably at least 55 mm, even more preferably at least 60 mm, however, not limited thereto.

For the suspension plasma spraying, conditions including current value, voltage value, gases, and gas feed rates are not particularly limited. Any well-known conditions of prior art may be applied. The spraying conditions may be determined as appropriate depending on the substrate, the slurry including rare earth oxide particles, a particular application of the resulting sprayed member, and the like.

A sprayed coating including rare earth oxide can be formed by suspension plasma spraying by using the inventive slurry for thermal spraying, and a sprayed member having the sprayed coating on a substrate can be manufactured. The rare earth oxide in the sprayed coating is preferably crystalline, and may contains one or more crystal systems such as cubical system and monoclinic system.

A sprayed coating having a porosity of up to 1 vol %, preferably up to 0.8 vol %, more preferably up to 0.5 vol % can be formed from the inventive slurry. A sprayed coating having a surface roughness Ra of up to 1.4 μm, preferably up to 1.1 μm can be formed from the inventive slurry. Further, a sprayed coating having a Vickers hardness of at least 500, preferably at least 550 can be formed from the inventive slurry.

Prior to forming a sprayed coating by using the inventive slurry for thermal spraying, a lower layer coating having a thickness of, e.g., 50 to 300 μm may be preliminarily formed on a substrate. As a coating formed on a substrate, a coating having a multilayer structure can be obtained when the sprayed coating as a surface layer coating is formed on the lower layer coating, preferably in contact with the lower layer coating by using the inventive slurry. As a material of the lower layer coating, a rare earth oxide, a rare earth fluoride and a rare earth oxyfluoride are exemplified. The lower layer coating can be formed by thermal spraying, for example, atmospheric plasma spraying or atmospheric suspension plasma spraying under normal pressure.

The lower layer coating preferably has a porosity of up to 5 vol %, more preferably up to 4 vol %, even more preferably up to 3 vol %. The lower layer coating preferably has a surface roughness of up to 10 μm, more preferably up to 5 μm. It is preferable that a sprayed coating is formed as the surface layer coating by using the inventive slurry on the lower layer coating having a small value of surface roughness Ra, preferably in contact with the lower layer coating. When the surface layer coating is formed in such way, the value of surface roughness Ra of die surface layer coating can be also small.

A method for forming the lower layer coating having a low porosity or a small surface roughness Ra is not particularly limited. For example, a dense lower layer coating having a porosity or a surface roughness Ra in the specific range can be formed by plasma spraying or explosion spraying with a powder of single particles or a granulated spraying powder as a raw material that has a particle size D50 of at least 0.5 μm, preferably at least 1 μm, and preferably up to 50 μm, more preferably up to 30 μm with melting the particles sufficiently. The powder of single particle herein means a powder having a spherical shape, a powder having an angular shape, a pulverized powder, and the like, and the particle is solidly filled with the contents. Since the powder of single particle is a powder consisting of particles filled with the contents, even fine particles having a smaller particle size compared with a granulated spraying powder, the powder of single particle can form a lower layer coating that includes a split having a small diameter and is controlled generation of cracks.

Further, a small surface roughness Ra can be obtained by surface treatment of each of the lower layer coating and surface layer coating by mechanical polishing (surface grinding, inner cylinder finishing, mirror finishing, and the like), blast treatment using micro beads, or hand polishing using a diamond pad. A surface roughness Ra of, e.g., 0.1 to 10 μm can be attained by the surface treatment. In particular, almost no crack and void can be found on a sprayed coating that is formed by suspension plasma spraying with the inventive slurry for thermal spraying and is conducted surface treatment because the quality of the coating is dense. Accordingly, the surface of a sprayed coating can be formed to like a surface of a sintered ceramic by the surface treatment.

EXAMPLES

Examples of the invention are given below by way of illustration and not by way of limitation.

Examples 1 to 4 and Comparative Examples 1 and 2

A slurry for thermal spraying including a dispersion medium and rare earth oxide particles shown in Table 1 was prepared. The content of the rare earth oxide particles was adjusted as shown in Table 1. A dispersing age t shown in Table 1 was added into the slurry in the amount shown in Table 1, except for Example 2.

For the rare earth oxide particles, particle sizes D10, D50 and D90, BET specific surface area, crystalline size on the crystal plane (431), and total volume of pores having a diameter of up to 10 μm were measured by the following respective methods. Further, for the slurry including the rare earth oxide particles, viscosity and sedimentation velocity were measured by the following respective methods. The results are shown in Table 1.

[Measurement of Particle Sizes]

Particle size distribution of the rare earth oxide, particles in the obtained slurry for thermal spraying was, measured by laser diffraction method in volume basis, and the particle sizes D10, D50 and D90 were evaluated. For the measurement, a laser diffraction/scattering type particle size distribution measuring apparatus "Microtrac MT3300EX II", manufactured by MicrotracBEL Corp., was used. The obtained slurry was added into 30 ml of pure water, irradiated with ultrasonic (40 W, 1 min), and then provided to evaluation as a sample. The sample was dropped into the circulation system of the measuring apparatus so as to be adjusted to Concentration Index DV (Diffraction Volume) of 0.01 to 0.09 that adopts to the specification of the measuring apparatus, and the measurement was subjected.

[Measurement of BET Specific Surface Area]

The BET specific surface area of the rare earth oxide particles in the obtained slurry for thermal spraying was measured by Full Automatic BET Specific Surface Area Analyzer, Macsorb HM model-1208, manufactured by Mountech Co., Ltd.

[Measurement of Crystalline Size on the Crystal Plane (431)]

X-ray diffraction profile of the rare earth oxide particles in the obtained slurry for thermal spraying was measured by X-ray diffraction method (characteristic X-ray: Cu Kα line), and the crystalline size was computed in accordance with Scherrer equation with the measured peak broadness (width) at half height of the diffraction peak that belongs to the crystal plane (431).

[Measurement of Pore Volume]

The pore volume of the rare earth oxide particles in the obtained slurry for thermal spraying was measured by mercury porosimetry with Mercury Porosimeter, AutoPore III, manufactured by Micromeritics Instrument Corporation, and from the obtained cumulative pore volume distribution relative to the pore diameter, total volume of pores having a diameter of up to 10 μm was computed.

[Measurement of Viscosity of Slurry]

The viscosity of the obtained slurry for thermal spraying was measured by Model TVB-10 viscometer, manufactured by Toki Sangyo Co., Ltd, at a rotation rate of 60 rpm, and a rotation time of 1 minute.

[Measurement of Sedimentation Velocity]

The sedimentation velocity of the obtained slurry for thermal spraying was measured by dispersing the slurry sufficiently, charging 700 mL of the slurry into a 1 L transparent glass beaker, measurnig the time of forming precipitate, and computing the sedimentation velocity with the height of slurry. The time point when the boundary between the precipitate and the slurry could be visually confirmed from outside of the beaker was determined as the time point at which the precipitate had been formed.

TABLE 1

| | Example 1 | Example 2 | Example 3 | Example 4 | Comparative Example 1 | Comparative Example 2 |
|---|---|---|---|---|---|---|
| Dispersion Medium | Water | Ethanol | Water | Water | Water | Water |
| Rare Earth Oxide Particle | $Y_2O_3$ | $Y_2O_3$ | $Gd_2O_3$ | $Y_2O_3$ | $Y_2O_3$ | $Y_2O_3$ |
| Particle Size D10 (μm) | 1.2 | 0.9 | 1.5 | 1.7 | 1 | 1.6 |
| Particle Size D50 (μm) | 2.7 | 2.4 | 4.6 | 2.8 | 2.4 | 3.9 |
| Particle Size D90 (μm) | 5.1 | 4.2 | 5.8 | 4.6 | 3.8 | 10 |
| BET Specific Surface Area ($m^2/g$) | 0.7 | 0.8 | 0.6 | 0.7 | 5 | 1.2 |
| Crystalline Size on Crystal Plane (431) (nm) | 900 | 850 | 700 | 850 | 500 | 600 |
| Total Volume of Pores Having Diameter of up to 10 μm ($cm^3/g$) | 0.39 | 0.41 | 0.28 | 0.37 | 0.65 | 0.56 |
| Content of Particles (wt %) | 30 | 45 | 10 | 30 | 30 | 50 |
| Dispersing Agent | Polyalkylene imine series | — | Polyvinyl alcohol series | Polyalkylene imine series | Polyalkylene imine series | Polyvinyl alcohol series |
| Content of Dipersing Agent (wt %) | 0.05 | — | 1 | 0.05 | 0.05 | 1 |
| Viscosity (mPa · s) | 3 | 5 | 10 | 3 | 10 | 15 |
| Sedimentation Velocity (μm/s) | 60 | 50 | 70 | 60 | 30 | 40 |

Next, a sprayed coating was formed on the substrate shown in Table 2 by suspension plasma spraying with the obtained slurry for thermal spraying. In Examples and Comparative Examples, except for Example 2, a sprayed coating (surface layer coating) including the rare earth oxide shown in Table 2 was directly finned on the substrate. In Example 2, a lower layer coating of yttrium oxide having a thickness of 200 μm was formed on the substrate by atmospheric plasma spraying, then a sprayed coating (surface layer coating) including the rare earth oxide shown in Table 2 was formed on the lower layer coating. A thermal spray system, CITS, manufactured by Progressive Surface Inc. was used for the suspension plasma spraying, and the suspension plasma spraying was conducted under air atmosphere (atmospheric suspension plasma spraying) under normal pressure. The spraying conditions (spraying distance, slurry feed rate, and electric power of spray gun) for suspension plasma spraying were applied as shown in Table 2, Further, thicknesses of the resulting lower and surface layer coatings were measured by Eddy-current Coating Thickness Tester, LH-300J, manufactured by Kett Electric Laboratory. The thickness of the surface layer coating is shown in Table 2.

The feed stability of slurry in suspension plasma spraying was shown in Table 2. In Example 1, slurry feed was very stable until the sprayed coating had been completed. However, in Comparative Example 1, the conduit was clogged with particles during slurry feed, thereby a sprayed coating (surface layer coating) could not be formed. Further, in Comparative Example 2, the sprayed coating could be formed, however, the slurry feed was unstable, and the conduit was clogged with particles just after the sprayed coating had been completed.

The porosity and surface roughness Ra of the obtained lower layer coating, porosity, surface roughness Ra and Vickers hardness of the obtained surface layer coating were measured and evaluated by the following respective methods. The results are shown in Table 2.

[Measurement of Porosity]

The obtained sprayed coating (lower layer coating and surface layer coating) was embedded into resin, cut out the cross-section surface, and polished the surface to mirror surface (surface roughness Ra: 0.1 μm). Then, electron microscopic images of the cross-section surface were taken (at 1,000 times magnification). The images were taken at five view fields (area of image: 0.01 $mm^2$ per view field) of the cross-section surface. The porosity was quantified by utilizing image analysis software "Image J" (provided from National Institutes of Health, software in the public domain), the porosity was computed as a ratio of the total area of pore portions to the total area of the observed image. The porosity was evaluated as an average of five view fields.

[Measurement of Surface Roughness Ra]

The surface roughness Ra of the obtained sprayed coating (lower layer coating and surface layer coating) was measured by surface texture measuring instrument, HANDYSURF E-35A, manufactured by Tokyo Seinntsu Co., Ltd.

[Measurement of Vickers Hardness]

The surface of sample piece was polished to mirror surface (surface roughness Ra: 0.1 μm), and the Vickers hardness of the obtained sprayed coating (surface layer coating) was measured at the surface of the sample piece by a micro Vickers hardness tester, AVK-C1, manufactured by Mitutoyo Corporation (loading: 300 gf (2.94 N), loading time: 10 min) The Vickers hardness was evaluated as an average of five points.

TABLE 2

| | Example 1 | Example 2 | Example 3 | Example 4 | Comparative Example 1 | Comparative Example 2 |
|---|---|---|---|---|---|---|
| Substrate | Aluminum Alloy | Alumite-treated Aluminum Alloy | Alumina | Quartz Glass | Aluminum Alloy | Aluminum Alloy |
| Spraying Method for Lower Layer Coating | — | Atmospheric Plasma Spraying | — | — | — | — |
| Oxide of Lower Layer Coating | — | $Y_2O_3$ | — | — | — | — |
| Thickness of Lower Layer Coating (μm) | — | 200 | — | — | — | — |
| Porosity of Lower Layer Coating (vol %) | — | 2 | — | — | — | — |
| Surface Roughness Ra of Lower Layer Coating (μm) | — | 4.2 | — | — | — | — |
| Spraying Method for Surface Layer Coating | Suspension Plasma Spraying | | | | | |
| Spraying Distance (mm) | 65 | 75 | 75 | 70 | 90 | 75 |
| Slurry Feed Rate (mL/min) | 30 | 40 | 30 | 35 | 40 | 30 |
| Electric Power of Spray Gun (kW) | 100 | 105 | 100 | 105 | 105 | 100 |
| Feed Stability | Very Stable | Very Stable | Very Stable | Very Stable | Clogging during slurry feed | Unstable Clogging after slurry feed |
| Oxide of Surface Layer Coating | $Y_2O_3$ | $Y_2O_3$ | $Gd_2O_3$ | $Y_2O_3$ | $Y_2O_3$ | $Y_2O_3$ |
| Thickness of Surface Layer Coating (μm) | 150 | 100 | 100 | 200 | — | 100 |
| Porosity of Surface Layer Coating (vol %) | 0.1 | 0.1 | 0.4 | 0.2 | — | 1.5 |
| Surface Roughness Ra of Surface Layer Coating (μm) | 0.9 | 3.2 | 1.1 | 1 | — | 1.5 |
| Vickers Hardness of Surface Layer Coating | 630 | 590 | 550 | 600 | — | 440 |

In Examples 1 to 4, very stable feeding was accomplished with by slurry with absolutely not clogging the conduit, thereby an erosion-resistant coating being very hard and dense was obtained. The inventive skin makes it possible to continue stable feed without clogging the conduit when the slurry is fed, and to form an erosion-resistant coating having a porosity of up to 1% and a Vickers hardness of at least 500 and being hard and dense by suspension plasma spraying, Japanese Patent Application No. 2018-151437 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A slurry for use in suspension plasma spraying comprising a dispersion medium and rare earth oxide particles wherein the rare earth oxide particles have a particle size D50 of 1.5 to 5 μm and a BET specific surface area of less than 1 $m^2/g$, and a content of the rare earth oxide particles in the slurry is 10 to 45 wt %, and wherein the rare earth oxide particles have a particle size D10 of at least 0.9 μm and a particle size D90 of up to 6 μm.

2. The slurry of claim 1 wherein the rare earth oxide particles have a crystalline size of at least 700 nm as measured on the crystal plane (431) by X-ray diffraction method.

3. The slurry of claim 1 wherein the rare earth oxide particles have a total volume of pores having a diameter of up to 10 μm in the range of up to 0.5 $cm^3/g$ as measured by mercury porosimetry.

4. The slurry of claim 1 wherein the rare earth element of which the rare earth oxide particles is composed comprises at least one element selected from the group consisting of Y, Gd, Tb, Dy, Ho, Er, Tm, Yb and Lu.

5. The slurry of claim 1 wherein the dispersion medium comprises one or more selected from the group consisting of water and alcohols.

6. The slurry of claim 1 comprising a dispersing agent in the range of up to 3 wt %.

7. The slurry of claim 1 having a viscosity of less than 15 mPa·s.

8. The slurry of claim 1 having a sedimentation velocity of particles in the range of at least 50 μm/s.

9. A method for forming a sprayed coating comprising a rare earth oxide on a substrate by suspension plasma spraying with the slurry of claim 1.

* * * * *